US008746022B2

(12) United States Patent
François et al.

(10) Patent No.: US 8,746,022 B2
(45) Date of Patent: Jun. 10, 2014

(54) PULL-UP LATCH MECHANISM

(75) Inventors: Sébastien François, Paliseul (BE); Christophe Grandjean, Vlessart-Leglise (BE)

(73) Assignee: Euro-Locks S.A., Bastogne (BE)

( * ) Notice: Subject to any disclaimer, the term of this patent is extended or adjusted under 35 U.S.C. 154(b) by 120 days.

(21) Appl. No.: 13/288,805

(22) Filed: Nov. 3, 2011

(65) Prior Publication Data

US 2012/0112475 A1 May 10, 2012

(30) Foreign Application Priority Data

Nov. 4, 2010 (GB) ..... 1018629.4

(51) Int. Cl.

| | |
|---|---|
| ***E05B 65/44*** | (2006.01) |
| ***E05B 65/06*** | (2006.01) |
| ***E05B 27/00*** | (2006.01) |
| ***E05B 9/10*** | (2006.01) |

(52) U.S. Cl.

USPC .... 70/83; 70/127; 70/128; 70/360; 70/379 R; 70/492

(58) Field of Classification Search

CPC ..... E05B 17/0025; E05B 5/00; E05B 9/08; E05C 5/00

USPC ..... 292/1, 195, 194, 200, 336.3, DIG. 49, 292/63, 64, 67; 70/83, 125, 127, 128, 70/379 A, 379 R, 422, 493, 492, 208, 360, 70/417, 404, 419, 491, 389

See application file for complete search history.

(56) References Cited

U.S. PATENT DOCUMENTS

| | | | | |
|---|---|---|---|---|
| 5,165,738 | A * | 11/1992 | McCormack | 292/67 |
| 5,606,882 | A * | 3/1997 | Larsen et al. | 70/369 |
| 6,640,592 | B2 * | 11/2003 | Vickers | 70/83 |
| 6,843,082 | B2 | 1/2005 | Vickers | |
| 7,441,427 | B2 | 10/2008 | Vickers | |
| 2002/0166353 | A1 * | 11/2002 | Vickers | 70/127 |
| 2004/0250579 | A1 * | 12/2004 | Capka et al. | 70/492 |
| 2008/0216532 | A1 * | 9/2008 | Flandrinck | 70/379 A |
| 2010/0064743 | A1 * | 3/2010 | Habecke | 70/255 |

FOREIGN PATENT DOCUMENTS

| | | | | |
|---|---|---|---|---|
| EP | 0069900 | A1 | 1/1983 | |
| EP | 1411198 | A1 * | 4/2004 | E05C 5/02 |
| GB | 2158866 | A | 11/1985 | |
| WO | 2009/043420 | A1 | 4/2009 | |

OTHER PUBLICATIONS

Search Report conducted Feb. 2, 2011 by the UK Intellectual Property Office for Application No. GB1018629.4.

* cited by examiner

*Primary Examiner* — Kristina Fulton
*Assistant Examiner* — Nathan Cumar
(74) *Attorney, Agent, or Firm* — Hovey Williams LLP

(57) ABSTRACT

A pull-up latch mechanism includes a stator (2) with an inner open channel (20), a cap (10) attached to a cylinder (1) lodged into the open channel (20) of the stator (2), a shaft (8) provided with a latching pawl, and a control system connecting the shaft (8) to the cylinder. The control system is adapted for generating a first movement of rotation of the cylinder, a movement of the shaft (8) away from the cylinder in the direction of the longitudinal axis, for generating a second movement of rotation of the cylinder, and a movement of the shaft towards the cylinder in the direction of a central axis.

16 Claims, 12 Drawing Sheets

PULL-UP LATCH MECHANISM

CROSS-REFERENCE TO RELATED APPLICATIONS

The present application claims the priority benefit of United Kingdom Patent Application No. 1018629.4, filed Nov. 4, 2010, the entire disclosure of which is hereby incorporated by reference herein in its entirety.

FIELD OF THE INVENTION

The invention relates to a pull-up latch mechanism, and to a method for building such a pull-up latch mechanism.

BACKGROUND OF THE INVENTION

Pull-up latch mechanism have already been used in the prior art. Such known pull-up latch mechanism comprises:

a stator with a substantially cylindrical inner open channel having a longitudinal axis and extending from a front opening up to a back opening with a cross section smaller than the section of the front opening, a cap attached to a cylinder (1), whereby the cylinder is adapted to be lodged into the open channel of the stator, when the cap is lodged at least partly into the front portion, whereby the cap and cylinder are adapted to rotate within the inner channel on the action of a control means, a shaft (8) provided with a latching pawl and provided with a hole for receiving a rod, and a control system comprising an outer sleeve and an inner sleeve provided each with a groove, said inner sleeve being inserted within the outer sleeve which is inserted within the inner channel of the stator through the front opening thereof.

a rod connects the shaft 8 with the said inner and outer sleeves, the end portions of the rod extending within the grooves of the said sleeves.

a system for connecting the outer sleeve with the cylinder.

Such systems are disclosed for example in GB2158866 and U.S. Pat. No. 7,441,427.

Drawbacks of such disclosed system is that inner and outer sleeves have to rotate with the channel of the stator, whereby increasing potential problem of gripping, as well as pivoting movements between the sleeves and/or with the shaft.

In such disclosed system there is no means for retaining the sleeves with the cylinder, as well as there is no means for maintaining the sleeve within the channel of the stator and/or for preventing some longitudinal movement of the sleeve in case the mechanism being in unlocked position.

In case of longitudinal movement of one or more sleeves, the shaft in unlocked position can also move longitudinal, whereby the latch can extend in a position preventing its rotation within a locked position.

EP1411198 disclose a latch mechanism comprising a drive input means arranged in a fixed housing, an output shaft connected to the drive input means. The output shaft is provided (a) with a L-shaped guide cam surface cooperating with a cam follower attached to the housing, and (b) an inclined cam surface cooperating with another cam follower pushed into a hole of an end of the drive input means, through a hole of the housing. In said mechanism, the drive input means is inserted into a sleeve of the output shaft, before inserting the drive input means and the output shaft within the axial passage of the housing through the back opening. Thereafter a guide pin has to be inserted through a lateral hole of the housing into the L shaped guide cam surface of the sleeve of the output shaft, so as to maintain the said sleeve into the housing. For the insertion of said cam follower, the sleeve and possibly the drive input means have to be correctly placed within the axial passage of the housing.

In such a mechanism, the cam follower acts as means for maintaining the sleeve into the passage of the housing, meaning that in case of excessive rotation of the sleeve, for example by a thieve, the cam follower can be broken off, whereby the sleeve can be pushed backwards, and whereby the mechanism is no more suitable to maintain locked a door, etc.

The mechanism of the invention aims to solve one or more of the problems listed hereabove.

SUMMARY OF THE INVENTION

The pull-up latch mechanism of the invention comprises:

a stator with a substantially cylindrical inner open channel having a longitudinal axis and extending from a front opening up to a back opening, whereby said inner channel comprises a central portion with a first substantially circular cross section perpendicular to the longitudinal axis and a front portion adjacent to said front opening and having a second substantially circular cross section perpendicular to the longitudinal axis and larger than the said first substantially cross section, the stator being provided with adjacent to its back opening with at least one inner groove system directed towards the inner channel, said inner groove system;

a cap attached to a cylinder, wherein said cylinder attached to the cap is adapted to be lodged into the open channel of the stator, when the cap is lodged at least partly into the front portion, whereby the cap and cylinder attached to the cap are adapted to rotate with respect to a rotation axis within the substantially cylindrical inner open channel of the stator on the action of a control key, whereby the cylinder attached to the cap is provided with a key slot in which the control key can be engaged, as well as slots with movable tumblers, wherein said tumblers are each movable against the action of at least one spring within their respective tumbler slot from (a) a first position in which a portion of the tumblers extends into a means selected from the group consisting of a groove of the stator and a recess of the stator so as to prevent rotation of the cylinder attached to the cap with respect to the stator, said first position being reached when the control key is not inserted into the key slot of the cylinder attached to the cap, and (b) a second position in which the tumblers are all located completely within their respective tumbler slot of the cylinder attached to the cap, whereby enabling a rotation of the cylinder attached to the cap into the substantially cylindrical inner open channel of the stator, said second position being at least achieved when the control key is inserted within the key slot of the cylinder attached to the cap;

a shaft provided with a latching pawl, and a control system connecting the shaft to the cylinder attached to the cap, said system being adapted:

for generating for a first movement of rotation of the cylinder attached to the cap a movement of the shaft away from the cylinder attached to the cap in the direction of the longitudinal axis of the substantially cylindrical inner open channel of the stator, and for generating for a second movement of rotation of the cylinder a movement of the shaft towards the cylinder attached to the cap in the direction of the longitudinal axis of the substantially cylindrical inner open channel of the stator.

In said pull-up latch mechanism of the invention, the said control system comprises a sleeve with a first end turned towards the cylinder attached to the cap and a second end opposite to the said first end, said first end having a slot adapted to cooperate with a retainer tumbler of the cylinder attached to the cap, while the sleeve has between its first end and second end an outer groove extending in a plane perpendicular to the rotation axis of the cylinder within the substantially cylindrical inner open channel of the stator, wherein the stator is provided with at least one opening for a first rod adapted to have a first portion extending into the said opening of the stator and a second portion extending within the outer groove of the sleeve, said rod acting as retaining means of the sleeve into the substantially cylindrical inner open channel of the stator, while enabling a rotation movement of the sleeve with respect to the stator.

The sleeve of the mechanism of the invention is provided with an inner chamber open at the second end of the sleeve, as well as with a first cam slot and a second cam slot adapted to guide a second rod having:

a first end portion extending at least in the first cam slot and partly within the first part of the said inner groove system of the stator, a second end portion extending at least in the second cam slot and partly within the second part of the said inner groove system of the stator, and a central portion extending though a hole of a shaft end portion extending through the second end of the sleeve within the inner chamber thereof, wherein the said first cam slot and said second cam slot have at least a substantially helical portion and are adapted to cooperate with the first and second parts of the inner groove system of the stator through the second rod, so as to transform a movement of rotation of the cylinder attached to the cap into a movement of translation of the shaft.

According to an advantageous embodiment, the said inner groove system of the stator comprises a first part and a second part separated the one with the other and having each at least a portion extending parallel to the longitudinal axis of the substantially cylindrical inner open channel According to an advantageous detail of embodiments of pull-up latch mechanism according to the invention, the retaining tumbler of the cylinder attached to the cap is adapted to be operated by a retaining control key able to move the retaining tumbler within the slot of the cylinder attached to the cap, so as to be able to remove the cap and the cylinder away from the stator via the front opening of the stator, while the retaining tumbler is adapted for not being operated by the locking control key adapted for moving the locking tumblers within their respective slot of the cylinder.

According to another advantageous embodiment of the invention, the retaining tumbler of the cylinder attached to the cap is adapted to be operated by a retaining control key able to move: (a) the retaining tumbler within the slot of the cylinder attached to the cap, as well as (b) the locking tumblers in their respective slot of the cylinder, so as to be able to remove the cap and cylinder away from the stator via the front opening of the stator, while the retaining tumbler is adapted for not being operated by the locking control key adapted for moving the locking tumblers within their respective slot of the cylinder.

Preferred embodiments of the invention have one or more of the following characteristics, advantageously a combinations of a plurality or combination of the following characteristics:

The retaining tumbler is adapted for having a retaining end portion to be inserted within an element of the first end of the sleeve selected from the group consisting of a slot of the said first end, an opening of the said first end and combination thereof, and/or the stator is provided with a substantially annular groove adapted to receive the retaining end of the portion of the retaining tumbler inserted in the said element of the first end of the sleeve, and/or the retaining tumbler is adapted for having a retaining end portion to be inserted within an element of the first end of the sleeve selected from the group consisting of a slot of the said first end, an opening of the said first end and combination thereof, while the stator is provided with a substantially annular groove adapted to receive the opposite end of the retaining tumbler opposite to the retaining end, and/or the retaining tumbler is adapted for having a retaining end portion to be inserted within an element of the first end of the sleeve selected from the group consisting of a slot of the said first end, an opening of the said first end and combination thereof, while the stator is provided with a substantially annular groove adapted to receive the retaining end of the portion of the retaining tumbler inserted in the said element of the first end of the sleeve, as well as adapted to receive the opposite end of the retaining tumbler opposite to the retaining end, and/or the cylinder attached to the cap has a back end having a shape, while the first end of the sleeve provided with the element adapted for receiving the retaining end portion of the retaining tumbler has the shape of a portion of a hollow cylindrical element extending on an arc comprised between 90° and 180°, wherein said shape of said portion of hollow cylindrical element is adapted to fit with the shape of the back end of the cylinder, and/or the sleeve is provided with an indexing means cooperating or working with at least one recess of the stator, and/or the cylinder is provided with at its back end opposite to the front end, with at least one protuberance adapted to be inserted within a recess of the front face of the sleeve, wherein said protuberance and recess have each at least three planar faces, while said protuberance and recess are shaped so that said at least three planar faces of the protuberance contact at least three planar faces of the recess, and/or the inner groove system has a portion open along the back opening of the stator, and/or the stator is provided with a passage for a rod, said passage and rod being adapted so that at least a portion of the first rod inserted into said passage extends within the substantially cylindrical inner open channel of the stator, and in which the sleeve is provided with a groove extending in a plan perpendicular to the longitudinal axis of the substantially cylindrical inner open channel of the stator, wherein the portion of the first rod located within the substantially cylindrical inner open channel of the stator extends into said groove of the sleeve, and/or the stator has two aligned passages at least open along the substantially cylindrical inner open channel, wherein the said first rod extends between and partly within two aligned passages of the stator, wherein the said first rod has a central portion located within the stator channel extends with said groove of the sleeve, and/or the stator is adapted for cooperating at least with a first sleeve and a second sleeve different from the first sleeve, in which the first sleeve and the second sleeve are each provided with a groove extending in a plan perpendicular to the longitudinal axis of the substantially cylindrical inner open channel of the stator, in which the stator is provided with at least a first passage open towards the substantially cylindrical inner open channel and a second passage open towards the substantially cylindrical inner open channel, wherein said first passage and said second passage are located at different positions in the direction of the longitudinal axis of said inner channel, wherein said first passage and said second passage are each adapted to cooperate with at least one rod, whereby the stator is cooperating with the first sleeve when a rod extending within the said first passage has a portion extending within the groove of the first sleeve, while the stator is cooperating with the second sleeve when a rod extending within the said second passage has a portion extending within the groove of the second sleeve, and/or the stator is provided with means for attaching the stator onto a support, advantageously selected from the group consisting of doors, windows, door frames, window frames, and profiles thereof.

The invention relates also to a method of assembling of a pull-up mechanism of the invention as disclosed here above and having one or more of the characteristics listed here above.

The method of the invention comprises at least the following steps:

attaching the shaft to the sleeve by inserting the rod through a cam slot of the sleeve, through the hole of the shaft end portion and through the other cam slot of the sleeve;

inserting the sleeve into the substantially cylindrical inner open channel of the stator, so that the rod attaching the shaft to the sleeve has its end portions located within the inner groove system of the stator;

inserting the cylinder into the stator channel so that the retainer tumbler of the cylinder has a portion entering within the opening of the first end of the sleeve, so that the cylinder is attached to the sleeve.

Advantageously, the sleeve is inserted within the substantially cylindrical inner open channel trough the front opening thereof.

Preferably, the sleeve is inserted within the substantially cylindrical inner open channel through the back opening thereof, by sliding the ends of the rod connecting the shaft to the sleeve though the portions of the groove system open along the back opening of the substantially cylindrical inner open channel According to a specific detail of a method of the invention, the cylinder is inserted at least partly within the substantially cylindrical inner open channel of the stator by operating a retaining control key, so that the retaining tumbler can be placed in front of the opening of the first end of the sleeve, and in which the retaining control key is removed from the key slot so that part of the retainer tumbler extends within the said opening of the first end of the sleeve.

Details and characteristics of a preferred pull-up latch mechanism will appear from the following description in which reference is made to the attached drawings.

DESCRIPTION OF PREFERRED EMBODIMENTS

Figure 1:
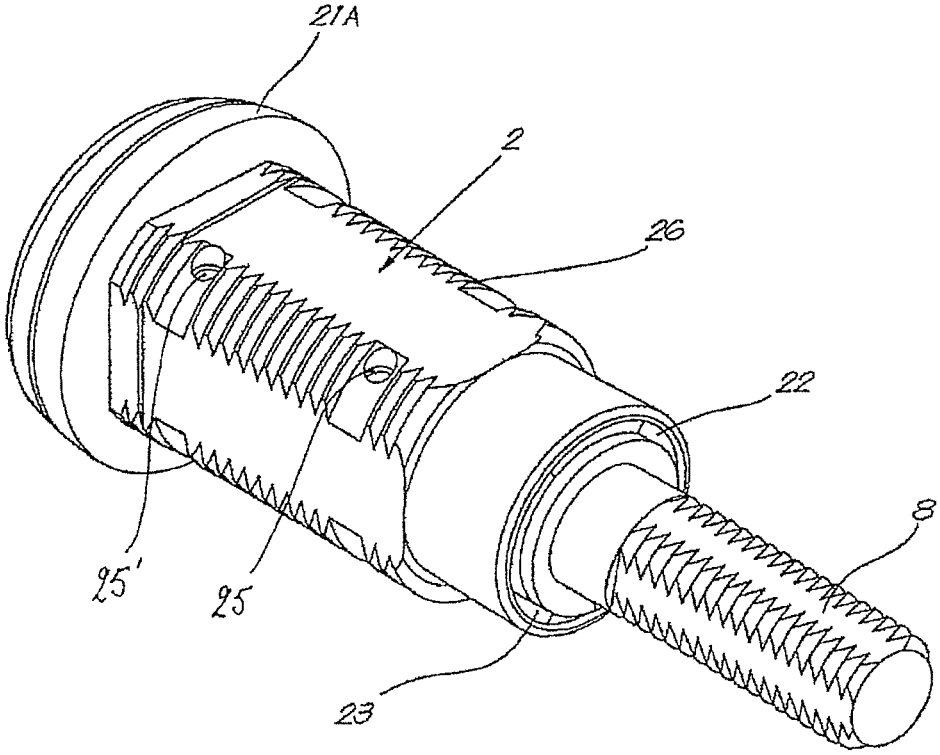
FIG. 1 is a perspective view of a mechanism according to the invention without the latching pawl.
Figure 2:
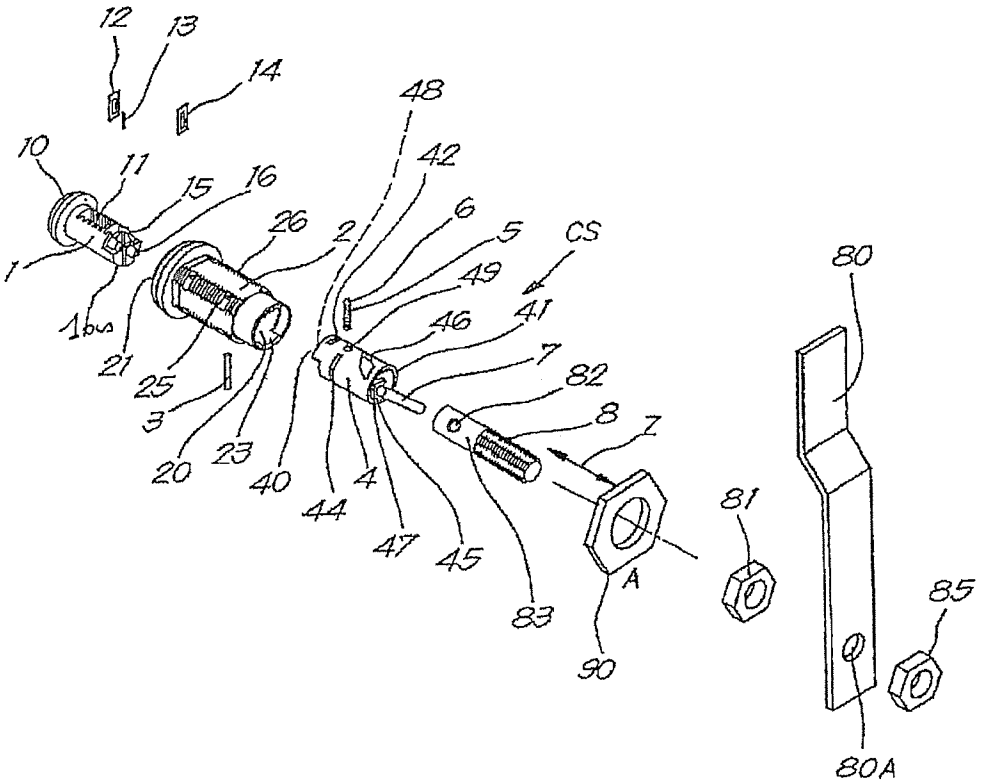
FIG. 2 is an exploded perspective view of the preferred mechanism of FIG. 1.

The pull-up latch mechanism of FIG. 1 broadly includes a stator 2, a cap 10 attached to a cylinder 1, a shaft 8, and a control system CS.

In greater detail, the stator 2 has a substantially cylindrical inner open channel 20 having a longitudinal axis A and extending from a front opening 21 up to a back opening 22, whereby said inner channel 20 comprises a central portion with a first substantially circular cross section perpendicular to the longitudinal axis and a front portion adjacent to said front opening and having a second substantially circular cross section perpendicular to the longitudinal axis and larger than the said first substantially cross section. The stator is provided with adjacent to its back opening 22 with at least one inner groove system 23 directed towards the inner channel 20 and comprising a first part and a second part separated the one with the other and having each at least a portion extending parallel to the longitudinal axis. An end 21A of the stator 2 is enlarged so as to be adapted for resting on the wall W when securing the nut 90 by screwing on the screw thread 26 of the stator body portion intended to be located at the rear side of the wall W.

The cap 10 is attached to a cylinder 1, wherein the cylinder 1 is adapted to be lodged into the open channel 20 of the stator 2, when the cap 10 is lodged at least partly into the front portion of the stator (adjacent to the front opening 21). The cap 10 and cylinder 1 are adapted to rotate within the inner channel 20 on the action of a control key. The cylinder 1 is provided with a key slot in which the control key can be engaged, as well as slots 11 with movable tumblers 12, whereby said tumblers 12 are movable against the action of one or more springs 13 within their respective tumbler slot from a first position in which a portion of the tumblers extends into a longitudinal groove or a recess (20 bis) of the stator so as to prevent rotation of the cylinder with respect to the stator 2 to a second position. The first position is reached when the control key is not inserted into the key slot of the cylinder. The position is a position in which the tumblers are all located completely within their respective tumbler slot 11 of the cylinder 1, whereby enabling a rotation of the cylinder into the channel of the stator. The second position is at least achieved when the control key is inserted within the key slot of the cylinder.

The shaft 8 is provided with a latching pawl 80 mounted on said shaft 8 by means of bolts 81.

The control system CS connects the shaft 8 to the cylinder 1. The system CS is adapted for generating for a first movement of rotation of the cylinder 1 (clockwise for example), a movement of the shaft 8 towards the cylinder 1 in the direction of the longitudinal axis, and for generating for a second movement of rotation (for example opposite to the first movement) of the cylinder 1 a movement of the shaft 8 away from the cylinder 1 in the direction of central axis.

The control system CS comprises a sleeve 4 with a first end 40 turned towards the cylinder 1 and a second end 41 opposite to the said first end, said first end 40 having a slot 42 adapted to cooperate with a retainer tumbler 14 of the cylinder 1. The slot 42 receives the retaining end of the retainer tumbler 14, thereby ensuring the cylinder 1 is retained within the channel of the housing.

The length of the retainer 14 is in an embodiment lower than the length of the locking tumblers 12, so that the retainer 14 is located within the slot 15 of the cylinder 1. The retainer tumbler 14 is movable within the slot 15 of the cylinder 1 against the action of a spring, whereby said slot 15 is adjacent to the end of the cylinder opposite to the front end or cap 10.

The sleeve 4 has, between said first and second ends 40 and 41 respectively, an outer groove 44 extending in a plane perpendicular to the rotation axis A of the cylinder within the channel 20 of the stator, said groove 44 extending for example on a circular path of about 270° along the outer cylindrical face of the sleeve 4. The stator 2 is provided with at least one opening 25 for a first rod 3 adapted to have a first portion extending into the opening 25 and a second portion extending within the outer groove 44 of the sleeve 4. The rod 3 acts as a retaining means of the sleeve 4 into the channel 20 of the stator 2, while enabling a rotational movement of the sleeve 4 with respect to the stator 2. Due to the fact that the groove 44 extends on a path portion of 270°, the rod 3 acts also as means for limiting the rotation of the rotor with respect to the stator. The stator can be provided with a second opening 25' adapted for receiving possibly another rod, for example in case the rotor is provided with another groove similar to the groove 44.

The sleeve 4 is provided with an inner chamber 45 open at the second end (back end) 41 of the sleeve 4, as well as with respective first and second cam slots 46,47 adapted to guide a second rod 7 having a first end portion extending at least in the first cam slot 46 and partly within the first part of the said inner groove system of the stator 2, a second end portion extending at least in the second cam slot and partly within the second part of the said inner groove system of the stator 2, and a central portion extending though a hole 82 of a shaft end portion 83 of the shaft 8 extending through the second end of the sleeve within the inner chamber 45. The cam slots 46,47 have one end (46A) having the shape of the rod and another end (46B) enlarged with respect to the shape of the rod.

The said first and second cam slots 46,47 have at least a substantially helical portion and are adapted to cooperate with the first and second parts of the inner groove system 23 of the stator 2 through the second rod 7, so as to transform a movement of rotation of the cylinder 1 into a movement of translation Z of the shaft 8.

When the rod 7 has portions located at the end (46A) of the cam slots 46,47 having substantially the shape of the said rod portion, and after insertion of the key for moving the locking tumbler 12 away from the groove 20 bis, i.e. into their slot of the cylinder 1, a rotation R1 of the cylinder 1 and sleeve 4 will cause the rod portion to follow the curved front edge 46F of the cam slots 46,47 (front edge directed towards the cylinder 1), thereby causing a movement M1 for the shaft 8 (the shaft 8 moving in the direction away from the sleeve 4, when contacting the portion 46FA of the edge). When said rod portion abuts the end 46B, the further rotation R1 of the cylinder 1 and sleeve 4 causes a rotation of the shaft 8, whereby the latching pawl 80 is rotated towards its open position. In said position the rod portion is still abutting the end 46B.

The key is then removed, whereby the locking tumblers have a portion extending within the bottom groove 20' bis of the stator.

When turning now the cylinder in the direction R2, the rod portion will first not be moved (the latch pawl remaining in open position), up to the rear edge 46R of the cam slot contacts the rod portion 7. When further rotating the cylinder 1 and the sleeve 4 in the direction R2, the rod portion 7 glides along the rear edge 46R, whereby causing a movement M2 of the shaft 8. When the rod portion is at the end 46A of the cam slot, a further rotation of the cylinder 1 and sleeve 4 causes the rotation of the shat 8 and of the latching pawl 80 towards the closed position.

The retaining tumbler 14 of the cylinder 1 is adapted to be operated by a retaining control key able to move within their respective slot 11 of the cylinder the locking tumblers 12 as well as the retaining tumbler 14 (against the action of springs 13), so as to be able to remove the cap 10 and cylinder 1 outside the stator 2 via the front opening of the stator 2.

The retaining tumbler 14 is adapted for not being operated by the locking control key adapted for moving the locking tumblers 12 within their respective slot 11 of the cylinder 1. The locking control key is thus unable to remove the cylinder 1 away from the stator, as the rod 3 keep the sleeve 4 within the stator, while the retaining tumbler 14 still connects the cylinder 1 to the sleeve 4.

The retaining tumbler 14 is adapted for having an end portion (such a protuberance) to be inserted within a slot 42 of the first end of the sleeve (4).

Figure 3:
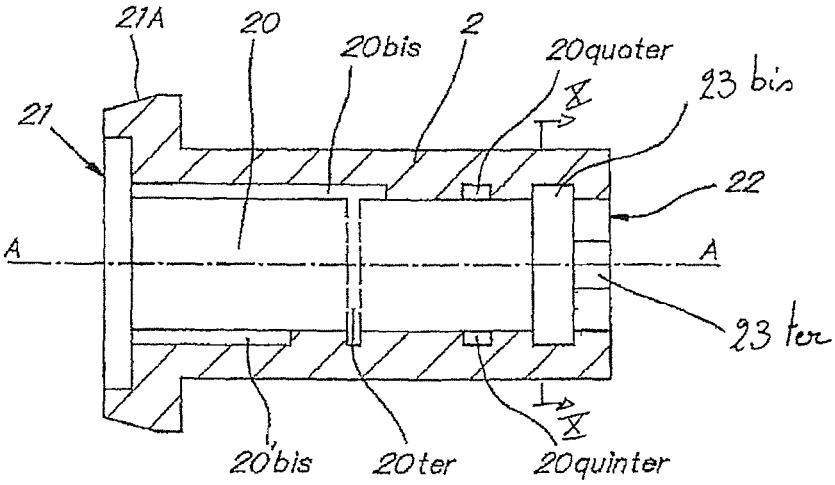
FIG. 3 is a cross section view of the stator of the mechanism of FIG. 1.
Figure 4:
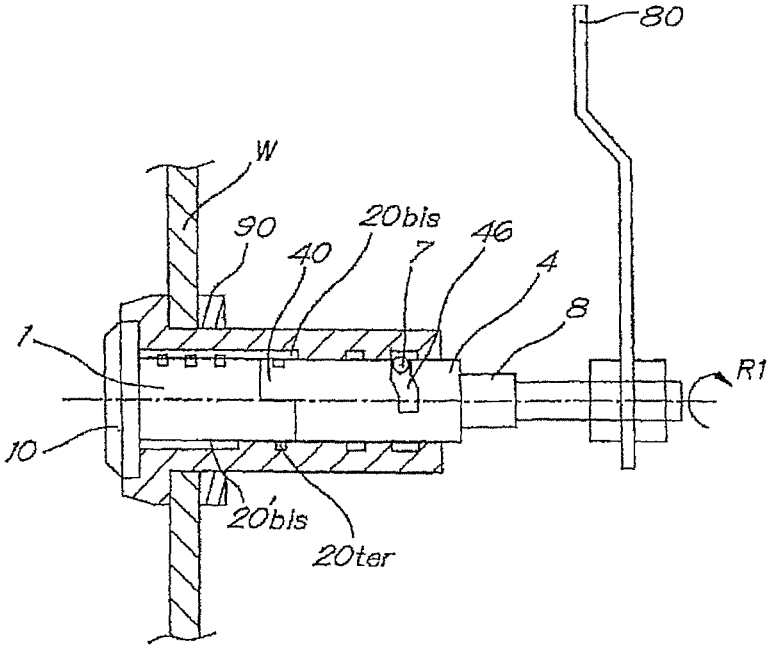
FIG. 4 is a cross-section view of the mechanism shown in FIG. 1 at one stage of driving into rotation of the rotor.
Figure 5:
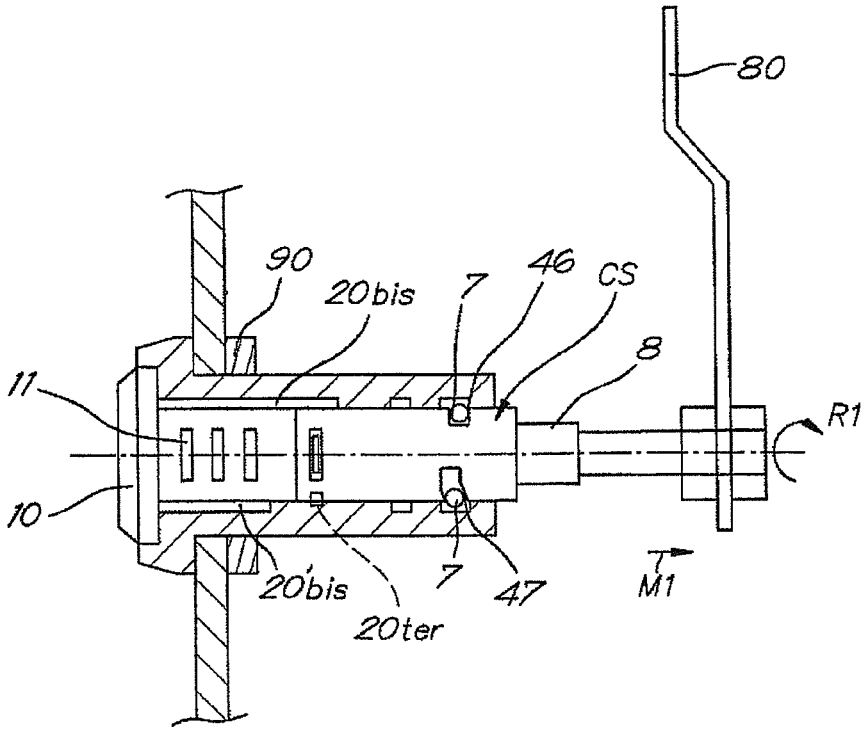
FIG. 5 is a cross-section view of the mechanism shown in FIG. 1 at another stage of driving into rotation of the rotor.
Figure 6:
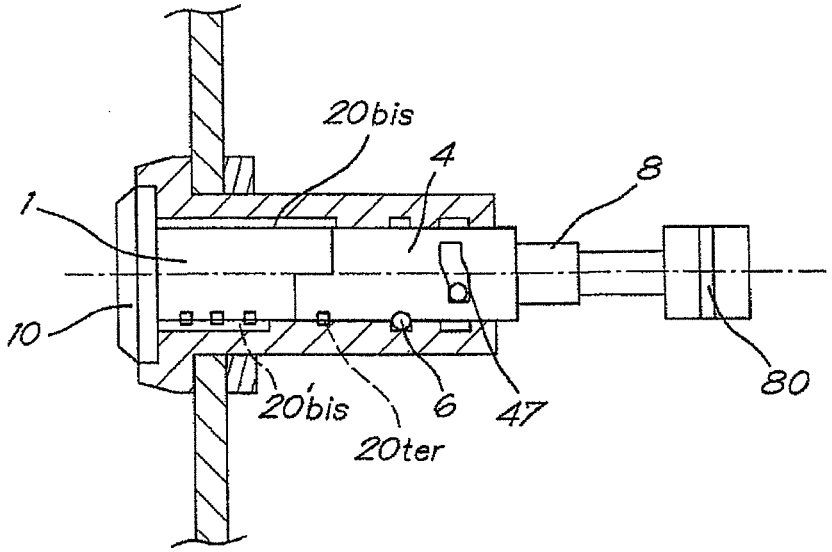
FIG. 6 is a cross section view of the mechanism shown in of FIG. 1 at another stage of driving into rotation of the rotor.
Figure 7:
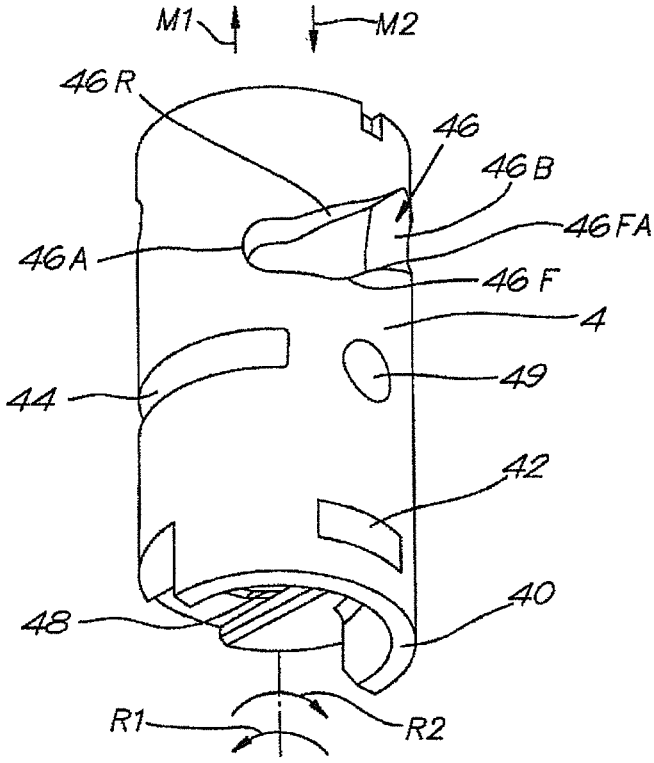
FIG. 7 is a perspective view of the sleeve of the mechanism of FIG. 1.
Figure 8:
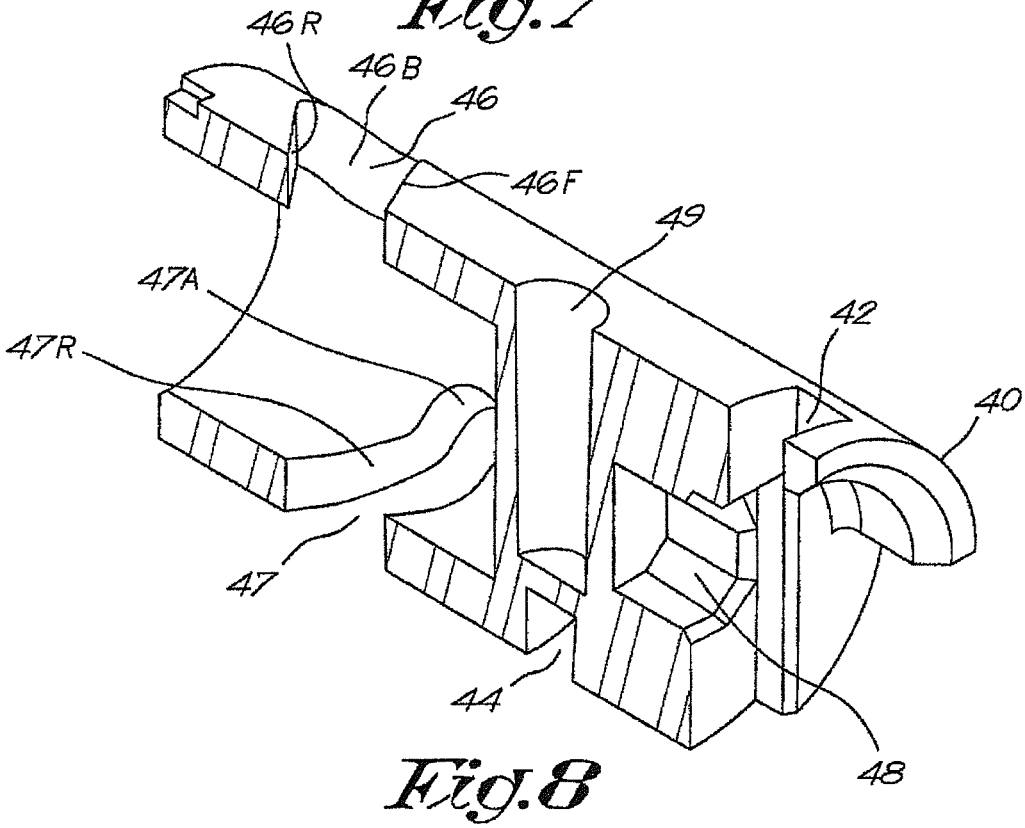
FIG. 8 is a cross section view taken along a plane extending longitudinally through the sleeve of FIG. 7 and passing diametrically through a cavity of the sleeve.
Figure 9:
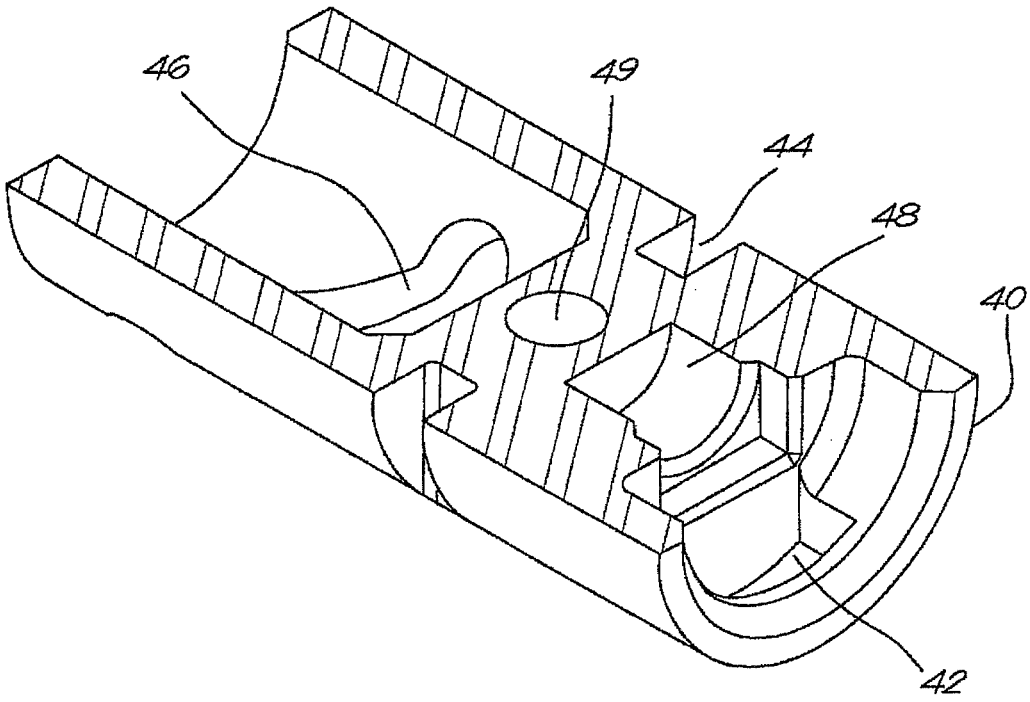
FIG. 9 is a cross section view taken along a plane extending longitudinally through the sleeve of FIG. 7 and perpendicular to the view of FIG. 8.
Figure 10:
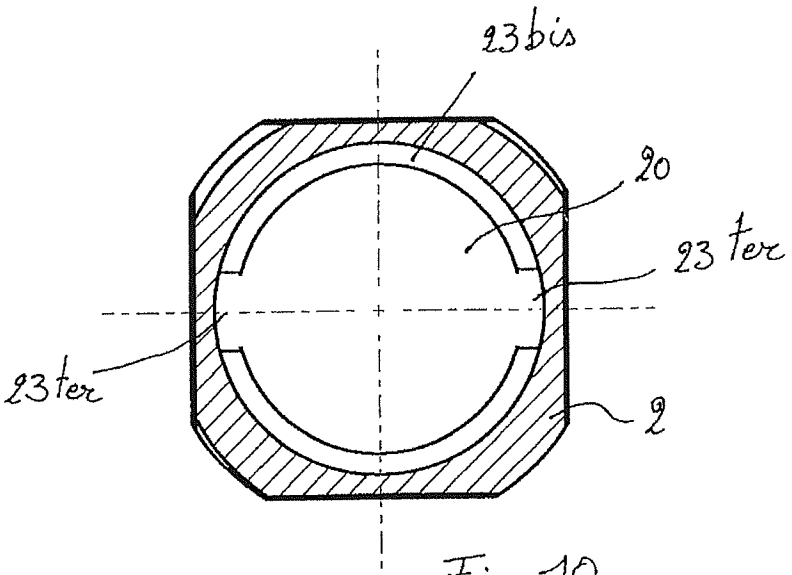
FIG. 10 is a cross section view of the stator of FIG. 3, showing the inner groove system with the annular groove and the longitudinal grooves.
Figure 11:
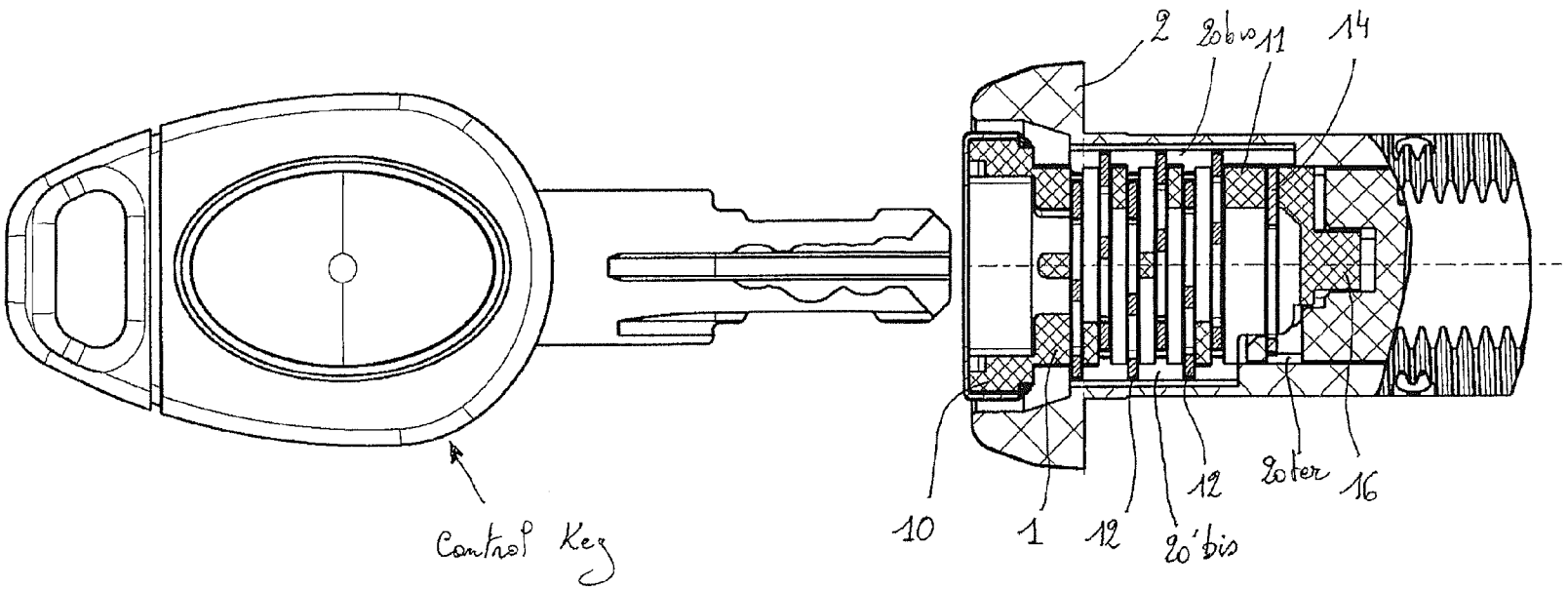
FIG. 11 is a cross section view of the mechanism of FIG. 1 with the rotation control key outside the key slot of the rotor, whereby the locking tumblers are in their first position for preventing rotation of the cylinder with respect to the stator, while the retainer tumbler has an end located within a slot.
Figure 12:
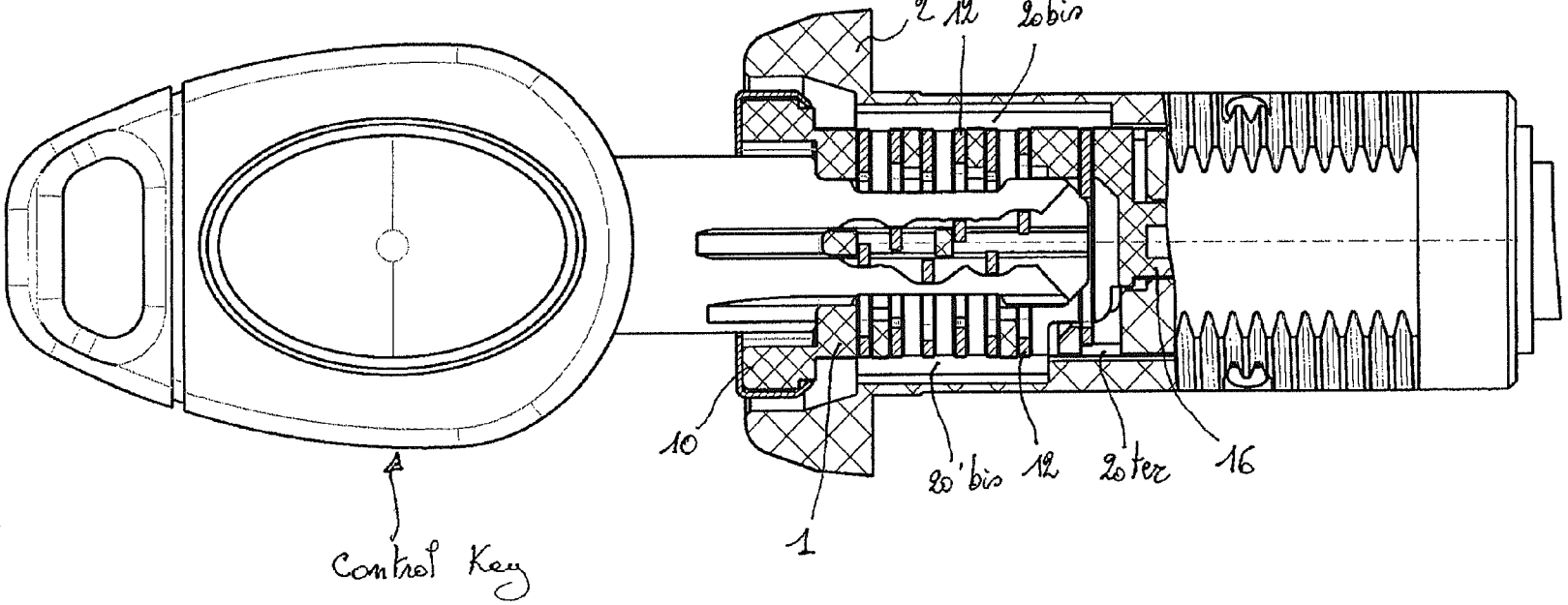
FIG. 12 is a cross section view of the mechanism of FIG. 1 with the control key within the key slot, whereby the locking tumblers are located within their respective slot of the cylinder, i.e. are in their second position for allowing rotation of the cylinder with respect to the stator, while the retainer tumbler has an end located within an annular groove of the stator.
Figure 13:
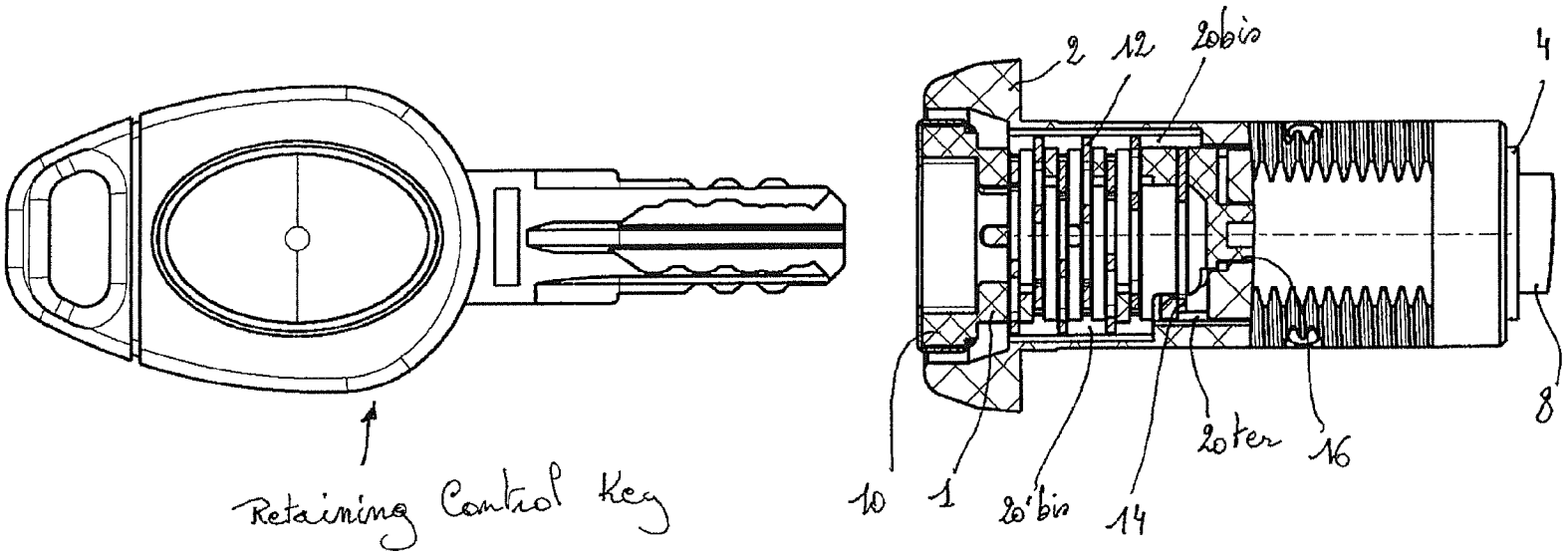
FIG. 13 is a cross section view of the mechanism of FIG. 1 with the control key outside the key slot of the cylinder, whereby the locking tumblers are in their first position for preventing rotation of the cylinder with respect to the stator, while the retainer tumbler has an end located within an annular groove of the stator.
Figure 14:
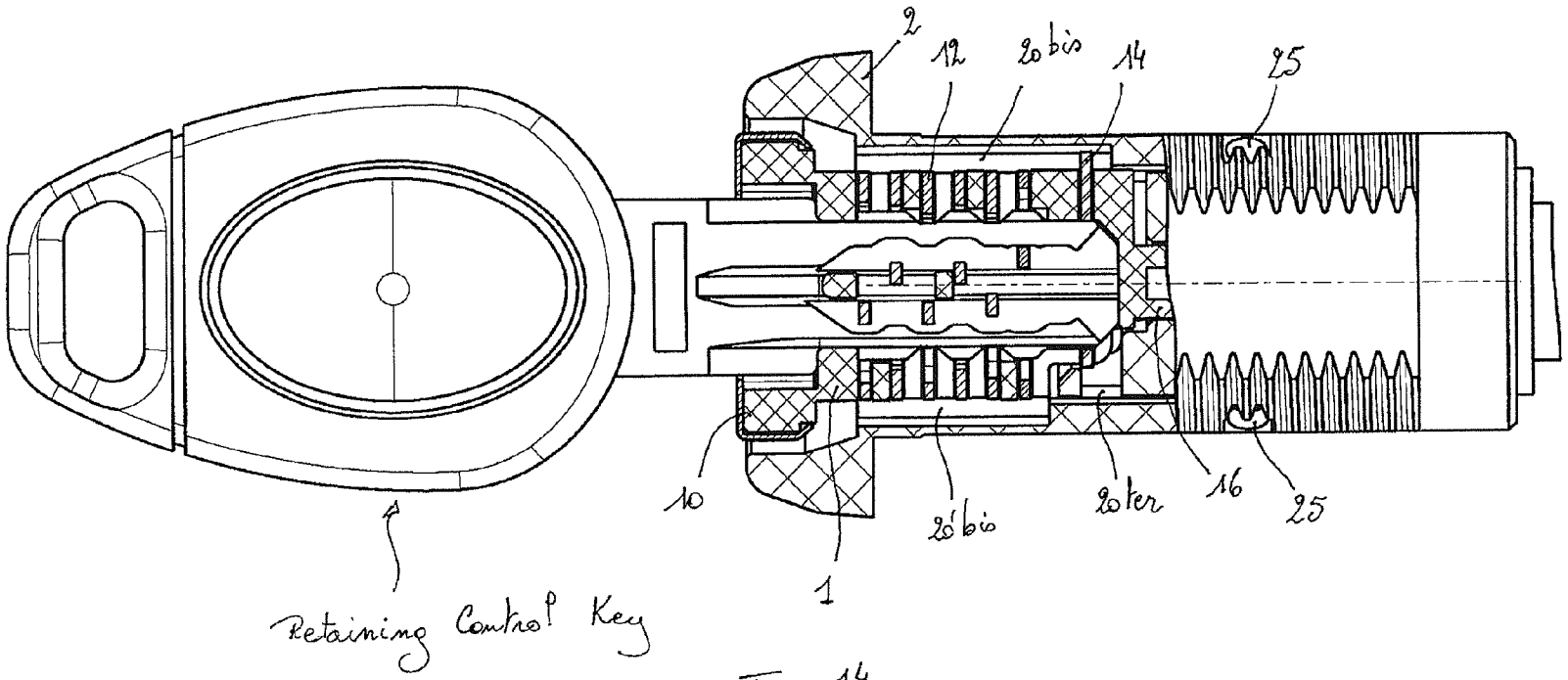
FIG. 14 is a cross section view of the mechanism of FIG. 1 with the retaining control key inside the key slot, whereby the locking tumblers and the retainer tumbler are located within their respective slot of the cylinder.
Figure 15:
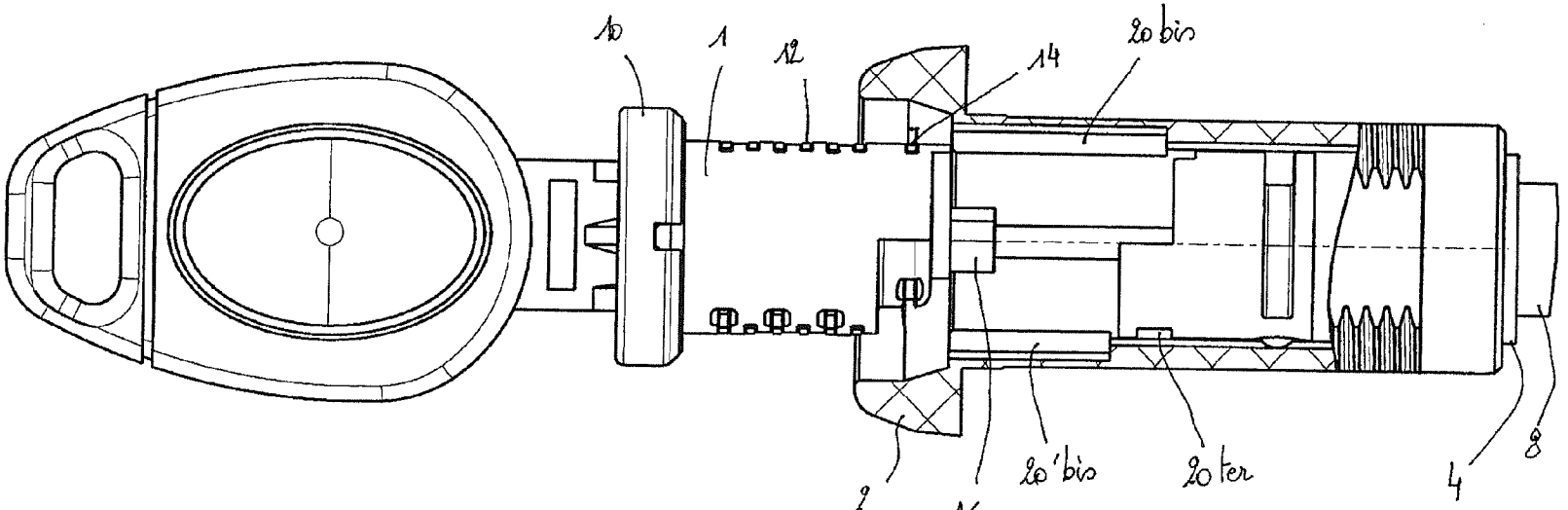
FIG. 15 is a cross section view of the cylinder removed outside the stator by the retaining control key.

According to a specific embodiment, the end top portion of said retaining tumbler 14 is adapted to extend outside the first end 42 of the sleeve (see embodiment of FIG. 8), said top end portion extending then in an annular groove 20 ter of the stator 2, said groove being shown in dashed lines in FIG. 3. In this way, the removal of the cylinder 1 away from the stator 2 by using the non appropriate tumbler controlling key is prevented by the retainer tumbler 14 and by the rod 3, due to the connection of the first end of the sleeve 4 with the cylinder 1 through the retainer tumbler. In this embodiment the retainer tumbler is able to move within the slot 15 of the cylinder, whereby enabling the removal of the cylinder out of the stator 2.

According to another specific embodiment, the retainer 14 has a length adapted so as to have one retaining end extending at least within the slot or opening 42 of the sleeve 4, when the retainer tumbler is not operated by the retaining control key, and so as to have the opposite end (opposite to the retaining end) extending within the annular groove 20 ter (shown in dashed lines) and/or in an extension of the longitudinal groove 20 bis (the total length of the groove 20 bis being then greater than the length of the groove 20' bis). When using an annular groove 20 ter, said annular groove is advantageously open towards the longitudinal groove 20 bis (groove intended to receive the locking tumbler ends in the locked position), but not open on the longitudinal groove 20' bis (groove intended to receive the locking tumbler ends in open position, after removal of the locking tumbler control key from the key slot of the cylinder). When inserting the retaining control key into the key slot of the cylinder, the opposite end of the retainer is moving into the annular groove 20 ter. For enabling the withdrawal of the cylinder 1, it is then necessary that the said opposite end extends in front of the longitudinal groove 20 bis, so as to enable said opposite end of the retaining tumbler to move in said groove 20 bis during the axial removal movement of the cylinder 1.

In the case, no annular groove 20 ter is used, the movement of the retainer into the slot 15 of the cylinder is advantageously possible only after rotation of the cylinder in the open position, whereby enabling the said opposite end of the retainer to extend with the longitudinal groove 20 bis, and no more within the opening 42 of the sleeve 4, enabling therefore the removal of the cylinder 1 by axial movement. In this case, when the cylinder 1 is not turned into its unlocked or open position, the movement of the retaining tumbler outside the opening 42 is for example prevented by the said opposite end of the retaining tumbler abutting against the inner surface of the channel of the stator 2.

The first end 40 of the sleeve 4 which is provided with the opening 42 for the retaining end of the retaining tumbler 14 has the shape of a portion of a hollow cylindrical element extending on an arc comprised between 90° and 180°, whereby said shape is adapted to fit with the shape of the back end of the cylinder. Such a shape is advantageous for ensuring a good transmission of the rotation couple of the cylinder to the sleeve, when rotating the cylinder with the appropriate locking/unlocking key.

The sleeve 4 is provided with an indexing means consisting of a spring 5 acting on a ball 6 cooperating/working with recesses 20 quater, 20 quinter of the stator 2. The spring 5 is placed within the cavity 49 of the sleeve 4.

The cylinder 1 is provided with at its back end 12 opposite to the front end 10, with at least one protuberance 16 adapted to be inserted within a recess 48 of the front face of the sleeve 4, whereby said protuberance 16 and recess 48 are shaped so that at least three planar faces of the protuberance contact three planar faces of the recess 48.

The inner groove system 47 has a portion 47A open along the back opening 41.

The stator 2 is provided with two aligned passages 25 for a rod 3, said passages 25 and rod 3 being adapted so that at least a portion of the rod 3 inserted into said passages 25 extends within the longitudinal channel 20 of the stator 2. The sleeve 4 is provided a groove 44 extending in a plane perpendicular to the longitudinal axis A (which is also the axis of rotation of the cylinder) of the stator channel, whereby the portion of the rod located within the stator channel extends with said groove 44 of the sleeve 4. The passages 23 ter communicates with the annular groove 23 bis in which the free ends of the rod 7 extend. Said groove 23 bis acts as means for limiting the longitudinal movement of the rod.

Possibly, the stator 2 can be provided with a series of passages for a rod located at different longitudinal positions, whereby the stator can cooperate with different sleeve 4, for example with a sleeve having a different length.

The stator is provided on its outer face with screw thread 26 adapted to be associated with a nut 90. Said nut is intended to be screwed on the screw thread of the stator 26, whereby the wall is clamped between the nut 90 and the front enlarged portion of the stator 2. In this way the stator is fixedly attached to the wall W.

The pull-up mechanism can be assembled as follows:

step 1: attaching the shaft 8 to the sleeve 4 by inserting the shaft 8 into the recess of the sleeve whereby the hole 82 of the end of the shaft is located in front of the two cam slots 46, and by placing the rod 7 through the two opposed cam slots 46 of the sleeve 4, while passing through the hole 82 of the shaft end portion 83. The two end portions of the rod 7 are intended to extend outside the cylindrical shape of the sleeve 4. Said end portions of the rod 7 are advantageously rounded so as to facilitate the movement of said end portions within the open channel 20 of the stator 2 more specifically within the inner groove system 23. An end portion of the rod is advantageously adapted for resting outside the sleeve. For example, said end portion has a size or diameter greater than the width of one cam slot 46.

step 2: inserting into the stator channel the sleeve 4 so that the rod attaching the shaft to the sleeve has its end portions located within the inner groove system 23. For said insertion, the end portions of the rod 7 are moved within the longitudinal grooves and then turned so as to extend within the inner groove system. The insertion of the sleeve 4 into the stator is operated from the back opening of the stator. In said case the sleeve and the open channel of the stator are adapted so as to prevent the sleeve to slide within and through the open channel of the stator 2, i.e. so as to prevent the sleeve 4 inserted through the back opening of the stator 2 to be able to go away from the open channel of the stator through the front opening. In another embodiment, less advantageous, the insertion is operated from the front opening of the stator 2.

step 3: adapting the position of the sleeve 4 within the stator channel 20, so that the openings 25 of the stator 2 and the outer groove 44 of the sleeve 4 are aligned, so that the rod 3 can be inserted into the openings 25 of the stator 2 and into the outer groove 44 of the sleeve. In this way, the longitudinal position of the sleeve 4 within the channel is well defined, the sleeve being still able to rotate with respect to the stator. One end of the rod 3 is provided with a clip mechanism so as to maintain the rod into the openings 25. In this way the longitudinal movement of the sleeve is counteracted by the rod 3, as well as by the rod 7, especially in case the ends of the rod 7 are located into a groove 23 limiting potential longitudinal movement towards the front end of the stator 2. Instead of being inserted through the back opening, the sleeve 4 can be inserted via the front opening of the stator.

step 4: inserting the cylinder 1 into the stator channel 20 so that the retainer tumbler 14 of the cylinder has a portion entering within the opening 42 of the first end of the sleeve 4, so that the cylinder is attached to the sleeve.

Advantageously, the cylinder is inserted at least partly within the stator channel with a retaining control key, so that the retaining tumbler can be placed in front of the opening of the first end of the sleeve, and in which the retaining control key is removed from the key slot so that part of the retainer tumbler extends within the said opening.

Step 5: after fixation of the stator on a support, for example on a door of a cabinet, the latching pawl 80 is fixed on the shaft 8, by using two nuts 81 between which the pawl 80 is clamped. So as to avoid rotation of the pawl 80 with respect to its shaft 8, the shaft 8 has a cross section with two opposite flat zones, while the opening 80A of the pawl has a section with two flat edges, said section corresponding the cross section of the shaft 8, whereby the flat zones of the shaft 8 contact the flat edges of the opening 80A.

The removal of a cylinder 1, for example for replacement due to a tentative of an inappropriate opening of the locking mechanism (for example by a thieve), can for example be operated by one or more of the following methods:

First Method optional inserting of the locking tumblers control key in the key slot of the cylinder so as to rotate the cylinder in its open position, and withdrawal of the locking control key (the ends of the locking tumblers extend now in the grooves 20 bis or 20' bis);

insertion of the retaining control key, so as to move the retaining end of the retainer outside the opening 42 of the sleeve, whereby enabling to move axially the cylinder 1 from the stator, while keeping the sleeve 4 within the channel of the stator.

and/or

Second Method insertion of the retaining control key, so as to move the retaining end of the retainer outside the opening 42 of the sleeve, as well optionally the locking retainers within the slots of the cylinder, whereby enabling to move axially the cylinder 1 from the stator, while keeping the sleeve 4 within the channel of the stator.

and/or

Third Method insertion of the retaining control key, so as to move the retaining end of the retainer outside the opening 42 of the sleeve, as well optionally the locking retainers within the slots of the cylinder, whereby enabling to rotate the cylinder towards its open position and thereafter enabling to move axially the cylinder 1 from the stator, while keeping the sleeve 4 within the channel of the stator.

What we claim is:

1. A pull-up latch mechanism comprising:

a stator comprising a body with a substantially cylindrical inner open channel having a longitudinal axis and extending from a front opening up to a back opening, whereby said inner channel comprises a central portion with a first substantially circular cross section perpendicular to the longitudinal axis and a front portion adjacent to said front opening and having a second substantially circular cross section perpendicular to the longitudinal axis and larger than the said first substantially cross section, the stator being provided with adjacent to its back opening with at least one inner groove system directed towards the inner channel, wherein the body of the stator has at least one passage extending up to the substantially inner open channel in a plane perpendicular to the longitudinal axis, wherein the said inner groove system comprising an annular groove provided with two longitudinal grooves extending between the annular groove and the back opening of the stator;

a cap attached to a cylinder, wherein said cylinder attached to the cap is adapted to be lodged into the open channel of the stator, when the cap is lodged at least partly into the front portion, whereby the cap and cylinder attached to the cap are adapted to rotate with respect to a rotation axis within the substantially cylindrical inner open channel of the stator on the action of a control key, whereby the cylinder attached to the cap is provided with a key slot in which the control key can be engaged, as well as slots with movable tumblers, wherein said tumblers are each movable against the action of at least one spring within their respective tumbler slot from (a) a first position in which a portion of the tumblers extends into a means selected from the group consisting of a groove of the stator and a recess of the stator so as to prevent rotation of the cylinder attached to the cap with respect to the stator, said first position being reached when the control key is not inserted into the key slot of the cylinder attached to the cap, and (b) a second position in which the tumblers are all located completely within their respective tumbler slot of the cylinder attached to the cap, whereby enabling a rotation of the cylinder attached to the cap into the substantially cylindrical inner open channel of the stator, said second position being at least achieved when the control key is inserted within the key slot of the cylinder attached to the cap;

a shaft provided with a latching pawl, and a control system connecting the shaft to the cylinder attached to the cap, said system being adapted:

for generating for a first movement of rotation of the cylinder attached to the cap a movement of the shaft away from the cylinder attached to the cap in the direction of the longitudinal axis of the substantially cylindrical inner open channel of the stator, and for generating for a second movement of rotation of the cylinder a movement of the shaft towards the cylinder attached to the cap in the direction of the longitudinal axis of the substantially cylindrical inner open channel of the stator, wherein the said control system comprises a sleeve with a first end turned towards the cylinder attached to the cap and a second end opposite to the said first end, said first end having a slot adapted to cooperate with a retainer tumbler of the cylinder attached to the cap, wherein the stator is provided with two aligned passages extending wherein the sleeve has between its first end and second end an outer groove extending in a plane perpendicular to the rotation axis of the cylinder within the substantially cylindrical inner open channel of the stator, wherein the at least one passage of the body of the stator is adapted for the passage of a first rod adapted to have a first portion extending into the said at least one passage of the body of the stator and a second portion extending within the outer groove of the sleeve, whereby said rod and outer groove of the sleeve are adapted so that said rod acts as retaining means of the sleeve into the substantially cylindrical inner open channel of the stator, while enabling a limited rotation movement of the sleeve with respect to the stator, wherein the sleeve is provided with an inner chamber open at the second end of the sleeve, as well as with a first cam slot and a second cam slot adapted to guide a second rod having:

a first end portion extending at least in the first cam slot and partly within the annular groove of the said inner groove system of the stator, a second end portion extending at least in the second cam slot and partly within the annular groove of the said inner groove system of the stator, and a central portion extending though a hole of a shaft end portion extending through the second end of the sleeve within the inner chamber thereof, wherein the said first cam slot and said second cam slot have at least a substantially helical portion and are adapted to cooperate with the annular groove of the inner groove system of the stator through the second rod, so as to transform a movement of rotation of the cylinder attached to the cap into a movement of translation of the shaft, and wherein the annular groove of the inner groove system is associated with two longitudinal grooves adapted for moving the first end portion and the second end portion of the second rod when inserting the sleeve into the open channel of the stator through its back opening.

2. The pull-up latch mechanism of claim 1, in which the retaining tumbler of the cylinder attached to the cap is adapted to be operated by a retaining control key able to move the retaining tumbler within the slot of the cylinder attached to the cap, so as to be able to remove the cap and the cylinder away from the stator via the front opening of the stator, and in which the retaining tumbler is adapted for not being operated by the locking control key adapted for moving the locking tumblers within their respective slot of the cylinder.

3. The pull-up latch mechanism of claim 1, in which the retaining tumbler of the cylinder attached to the cap is adapted to be operated by a retaining control key able to move: (a) the retaining tumbler within the slot of the cylinder attached to the cap, as well as (b) the locking tumblers in their respective slot of the cylinder, so as to be able to remove the cap and cylinder away from the stator via the front opening of the stator, and in which the retaining tumbler is adapted for not being operated by the locking control key adapted for moving the locking tumblers within their respective slot of the cylinder.

4. The pull-up latch mechanism of claim 1, in which the retaining tumbler is adapted for having a retaining end portion to be inserted within an element of the first end of the sleeve selected from the group consisting of a slot of the said first end, an opening of the said first end and combination thereof.

5. The pull-up latch mechanism of claim 4, in which the stator is provided with a substantially annular groove adapted to receive the retaining end of the portion of the retaining tumbler inserted in the said element of the first end of the sleeve.

6. The pull-up latch mechanism of claim 1, in which the retaining tumbler is adapted for having a retaining end portion to be inserted within an element of the first end of the sleeve selected from the group consisting of a slot of the said first end, an opening of the said first end and combination thereof, and in which the stator is provided with a substantially annular groove adapted to receive the opposite end of the retaining tumbler opposite to the retaining end.

7. The pull-up latch mechanism of claim 1, in which the retaining tumbler is adapted for having a retaining end portion to be inserted within an element of the first end of the sleeve selected from the group consisting of a slot of the said first end, an opening of the said first end and combination thereof, and in which the stator is provided with a substantially annular groove adapted to receive the retaining end of the portion of the retaining tumbler inserted in the said element of the first end of the sleeve, as well as adapted to receive the opposite end of the retaining tumbler opposite to the retaining end.

8. The pull-up mechanism of claim 4, in which the cylinder attached to the cap has a back end having a shape, and a in which the first end of the sleeve provided with the element adapted for receiving the retaining end portion of the retaining tumbler has the shape of a portion of a hollow cylindrical element extending on an arc comprised between 90° and 180°, wherein said shape of said portion of hollow cylindrical element is adapted to fit with the shape of the back end of the cylinder.

9. The pull up latch mechanism of claim 1, in which the sleeve is provided with an indexing means cooperating or working with at least one recess of the stator.

10. The pull up latch mechanism of claim 1, in which the cylinder is provided with at its back end opposite to the front end, with at least one protuberance adapted to be inserted within a recess of the front face of the sleeve, wherein said protuberance and recess have each at least three planar faces, and wherein said protuberance and recess are shaped so that said at least three planar faces of the protuberance contact at least three planar faces of the recess.

11. The pull-up latch mechanism of claim 1, in which the stator is provided with a passage for a rod, said passage and rod being adapted so that at least a portion of the first rod inserted into said passage extends within the substantially cylindrical inner open channel of the stator, and in which the sleeve is provided with a groove extending in a plan perpendicular to the longitudinal axis of the substantially cylindrical inner open channel of the stator, wherein the portion of the rod located within the substantially cylindrical inner open channel of the stator extends into said groove of the sleeve.

12. The pull-up latch mechanism of claim 11, in which the stator has two aligned passages at least open along the substantially cylindrical inner open channel, wherein the said first rod extends between and partly within two aligned passages of the stator, wherein the said rod has a central portion located within the stator channel extends with said groove of the sleeve.

13. The pull-up mechanism of claim 1, in which the stator is provided with means for attaching the stator onto a support.

14. The pull-up mechanism of claim 13, in which the stator is provided with a means for attaching it on a support element selected from the group consisting of doors, windows, door frames, window frames, and profiles thereof.

15. A method of assembling of a pull-up latch mechanism comprising:

a stator comprising a body with a substantially cylindrical inner open channel having a longitudinal axis and extending from a front opening up to a back opening, whereby said inner channel comprises a central portion with a first substantially circular cross section perpendicular to the longitudinal axis and a front portion adjacent to said front opening and having a second substantially circular cross section perpendicular to the longitudinal axis and larger than the said first substantially cross section, the stator being provided with adjacent to its back opening with at least one inner groove system directed towards the inner channel, wherein the body of the stator has at least one passage extending up to the substantially inner open channel in a plane perpendicular to the longitudinal axis, wherein the said inner groove system comprising an annular groove provided with two longitudinal grooves extending between the annular groove and the back opening of the stator;

a cap attached to a cylinder, wherein said cylinder attached to the cap is adapted to be lodged into the open channel of the stator, when the cap is lodged at least partly into the front portion, whereby the cap and cylinder attached to the cap are adapted to rotate with respect to a rotation axis within the substantially cylindrical inner open channel of the stator on the action of a control key, whereby the cylinder attached to the cap is provided with a key slot in which the control key can be engaged, as well as slots with movable tumblers, wherein said tumblers are each movable against the action of at least one spring within their respective tumbler slot from (a) a first position in which a portion of the tumblers extends into a means selected from the group consisting of a groove of the stator and a recess of the stator so as to prevent rotation of the cylinder attached to the cap with respect to the stator, said first position being reached when the control key is not inserted into the key slot of the cylinder attached to the cap, and (b) a second position in which the tumblers are all located completely within their respective tumbler slot of the cylinder attached to the cap, whereby enabling a rotation of the cylinder attached to the cap into the substantially cylindrical inner open channel of the stator, said second position being at least achieved when the control key is inserted within the key slot of the cylinder attached to the cap;

a shaft provided with a latching pawl, and a control system connecting the shaft to the cylinder attached to the cap, said system being adapted:

for generating for a first movement of rotation of the cylinder attached to the cap a movement of the shaft away from the cylinder attached to the cap in the direction of the longitudinal axis of the substantially cylindrical inner open channel of the stator, and for generating for a second movement of rotation of the cylinder a movement of the shaft towards the cylinder attached to the cap in the direction of the longitudinal axis of the substantially cylindrical inner open channel of the stator, wherein the said control system comprises a sleeve with a first end turned towards the cylinder attached to the cap and a second end opposite to the said first end, said first end having a slot adapted to cooperate with a retainer tumbler of the cylinder attached to the cap, wherein the stator is provided with two aligned passages extending wherein the sleeve has between its first end and second end an outer groove extending in a plane perpendicular to the rotation axis of the cylinder within the substantially cylindrical inner open channel of the stator, wherein the at least one passage of the body of the stator is adapted for the passage of a first rod adapted to have a first portion extending into the said at least one passage of the body of the stator and a second portion extending within the outer groove of the sleeve, whereby said rod and outer groove of the sleeve are adapted so that said rod acts as retaining means of the sleeve into the substantially cylindrical inner open channel of the stator, while enabling a limited rotation movement of the sleeve with respect to the stator, wherein the sleeve is provided with an inner chamber open at the second end of the sleeve, as well as with a first cam slot and a second cam slot adapted to guide a second rod having:

a first end portion extending at least in the first cam slot and partly within the annular groove of the said inner groove system of the stator, a second end portion extending at least in the second cam slot and partly within the annular groove of the said inner groove system of the stator, and a central portion extending though a hole of a shaft end portion extending through the second end of the sleeve within the inner chamber thereof, wherein the said first cam slot and said second cam slot have at least a substantially helical portion and are adapted to cooperate with the annular groove of the inner groove system of the stator through the second rod, so as to transform a movement of rotation of the cylinder attached to the cap into a movement of translation of the shaft, and wherein the annular groove of the inner groove system is associated with two longitudinal grooves adapted for moving the first end portion and the second end portion of the second rod when inserting the sleeve into the open channel of the stator through its back opening, said method comprising at least the following steps:

attaching the shaft to the sleeve by inserting the second rod through a cam slot of the sleeve, through the hole of the shaft end portion and through the other cam slot of the sleeve;

inserting the sleeve attached to the shaft by the second rod into the substantially cylindrical inner open channel of the stator, by sliding the end portions of the second rod into the two longitudinal grooves up to the annular groove of the inner groove system, so that the second rod attaching the shaft to the sleeve has its end portions located within the inner groove system of the stator, whereby;

inserting the cylinder into the stator channel so that the retainer tumbler of the cylinder has a portion entering within the opening of the first end of the sleeve, so that the cylinder is attached to the sleeve.

16. The method of claim 15, in which the cylinder is inserted at least partly within the substantially cylindrical inner open channel of the stator by operating a retaining control key, so that the retaining tumbler can be placed in front of the opening of the first end of the sleeve, and in which the retaining control key is removed from the key slot so that part of the retainer tumbler extends within the said opening of the first end of the sleeve.

* * * * *